US007032476B2

(12) United States Patent
Lin

(10) Patent No.: US 7,032,476 B2
(45) Date of Patent: Apr. 25, 2006

(54) TORQUE ADJUSTABLE TOOL

(75) Inventor: Chorng-Jiang Lin, Taichung (TW)

(73) Assignee: Lotuskate Sports Industrial Co., Ltd., Taichung (TW)

( * ) Notice: Subject to any disclaimer, the term of this patent is extended or adjusted under 35 U.S.C. 154(b) by 0 days.

(21) Appl. No.: 10/865,804

(22) Filed: Jun. 14, 2004

(65) Prior Publication Data

US 2005/0274230 A1 Dec. 15, 2005

(51) Int. Cl.
*B25B 13/00* (2006.01)

(52) U.S. Cl. ..... 81/58.3; 81/473

(58) Field of Classification Search ..... 81/58.3, 81/177.1, 473–477
See application file for complete search history.

(56) References Cited

U.S. PATENT DOCUMENTS 2,707,893 A * 5/1955 Bohnet ..... 81/58.3
2,968,979 A * 1/1961 Aijala ..... 81/474
3,695,059 A * 10/1972 Laubach ..... 464/23
3,942,337 A * 3/1976 Leonard et al. ..... 464/36
4,272,973 A * 6/1981 Fu-Tsai ..... 464/23
4,901,610 A * 2/1990 Larson et al. ..... 81/473
6,128,984 A * 10/2000 Haupt ..... 81/473
6,155,147 A * 12/2000 Dzieman ..... 81/473
6,339,977 B1 * 1/2002 Lee et al. ..... 81/58.3
6,640,674 B1 * 11/2003 Rinner et al. ..... 81/475
6,799,480 B1 * 10/2004 Walsh et al. ..... 73/862.21
6,832,533 B1 * 12/2004 Huang ..... 81/475

* cited by examiner

*Primary Examiner*—David B. Thomas
(74) *Attorney, Agent, or Firm*—Rosenberg, Klein & Lee

(57) ABSTRACT

A torque adjustable tool includes an active member and a passive member which is removably connected to the active member by two respective clutch portions. Driving power is connected to the active member and the passive member outputs a torque. A spring is mounted to the passive member and biased between an inner periphery of a control member mounted to the passive member and an enlarged portion of the passive member. The control member includes a clamping portion to which a locking member is threadedly mounted. By operating the locking member, the clamping portion can be clamped inward to be securely mounted to the passive member as one piece so as to completely transfer the torque from the driving power, or the clamping portion is opened outward such that the passive member can output a torque that is less than the force applied by the spring.

8 Claims, 6 Drawing Sheets

TORQUE ADJUSTABLE TOOL

FIELD OF THE INVENTION

The present invention relates to a toque adjustable tool including a locking device to optionally adjust the passive member to be movable or secured relative to the active member so as to partially or completely transfer the torque form the active member.

BACKGROUND OF THE INVENTION

A conventional hand tool for reaching an object (a screw, for example) located in a deep recess generally uses an extension rod which has one end connected to the driving or active member so that the power may transfer to the extension rod, and the other end of the extension rod is connected to a screw bit for example to rotate the object. Nevertheless, when the active member is driven by an electric power tool, there is a time lap between the electric power tool and the screw bit. In other words, the torque could be too much for the object and the surface where the object is located which is damaged. This is partially because the length of the path that the power is to be transferred is too long so that the user's hand cannot precisely feel the feed back of the resistance from the object and the receive of the feed back is a little bit delay. Therefore, extra torque is sent to the screw bit to overly screw the object.

Although at least one torque adjustable tool is disclosed and capable of keeping the output torque below a pre-set value. But the tool is useless if the user does not need any output torque restriction, in this situation, the user has to use another tool that does not have any feature to restrict the output torque.

The present invention intends to provide a torque adjustable tool that the user can optionally set the tool to be a torque adjustable tool or a simply a torque tool without any output adjusting feature. By the tool of the present invention, the output torque can be set so as to avoid damage to the object, and the output torque can be set to be the same as the driving power without any restriction.

SUMMARY OF THE INVENTION

The present invention relates to a torque adjustable tool which comprises an active member having a first clutch portion which is engaged with a second clutch portion of a passive member. A safety device is mounted to the active member and the passive member. The safety device has a control member and a spring is located between the control member and the first and second clutch portions. A locking device has a locking member which locks the active member to be integral with the passive member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
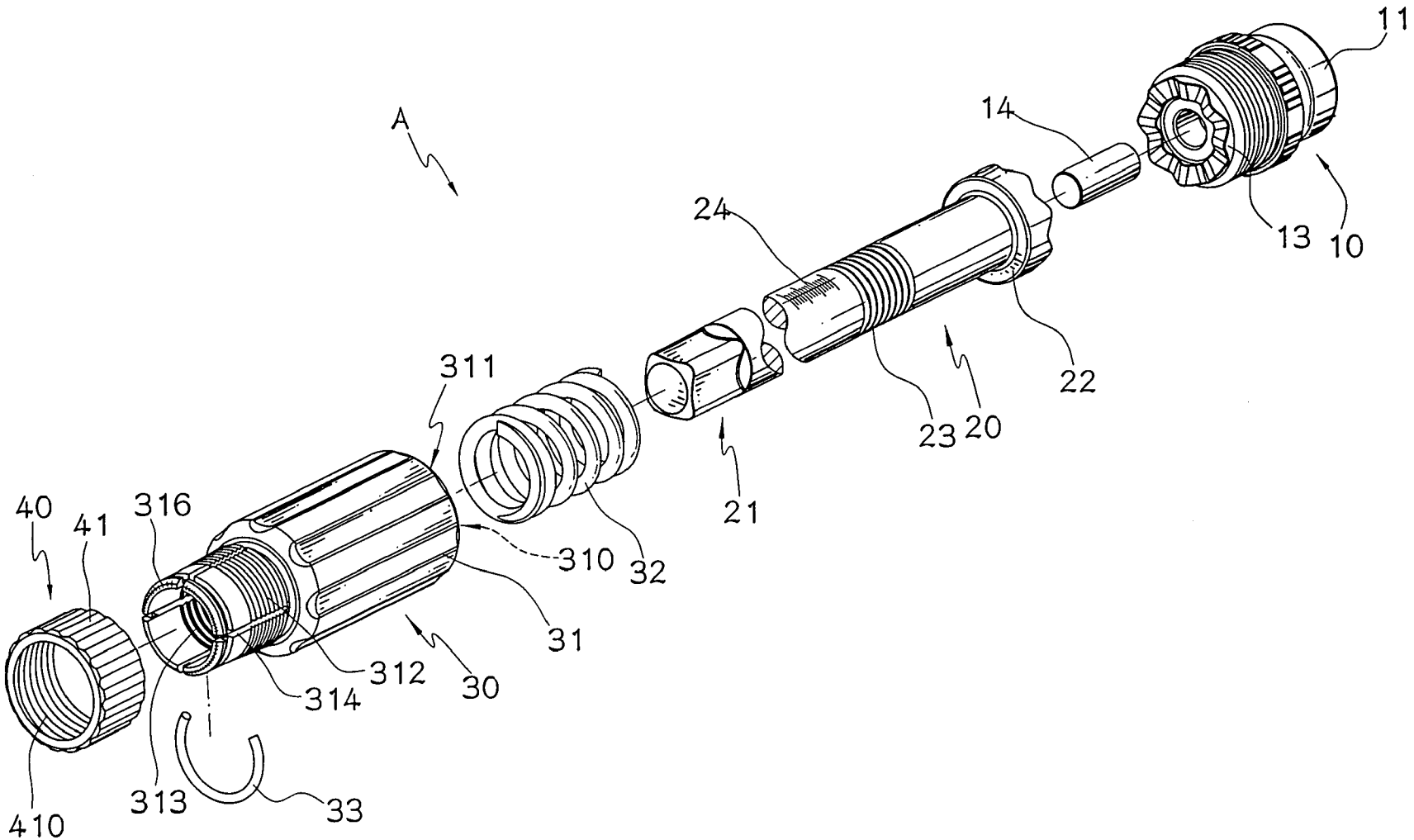
FIG. 1 is an exploded view to show the tool of the present invention.
Figure 2:
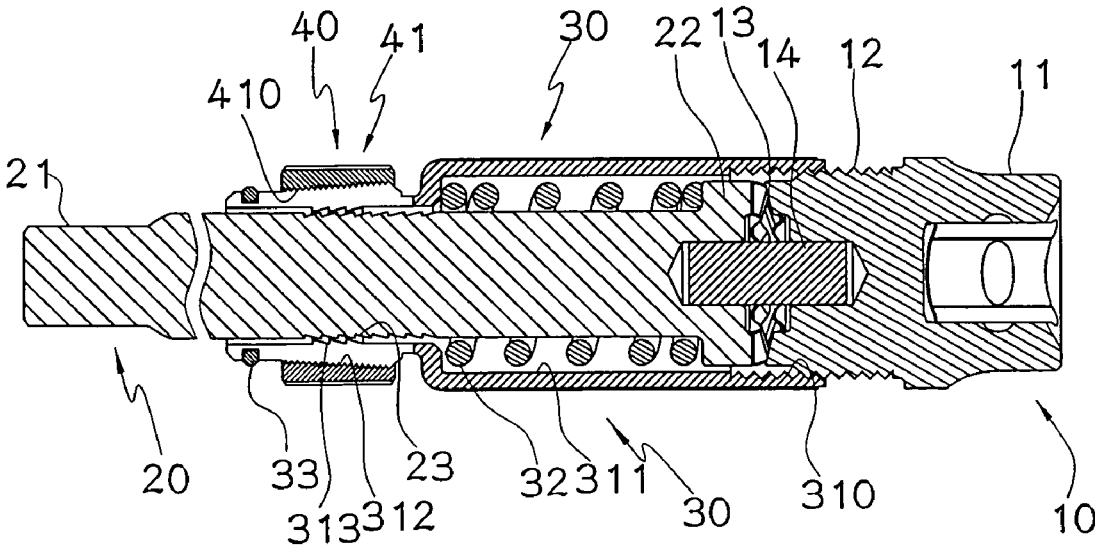
FIG. 2 is a cross sectional view to show the tool of the present invention.
Figure 3:
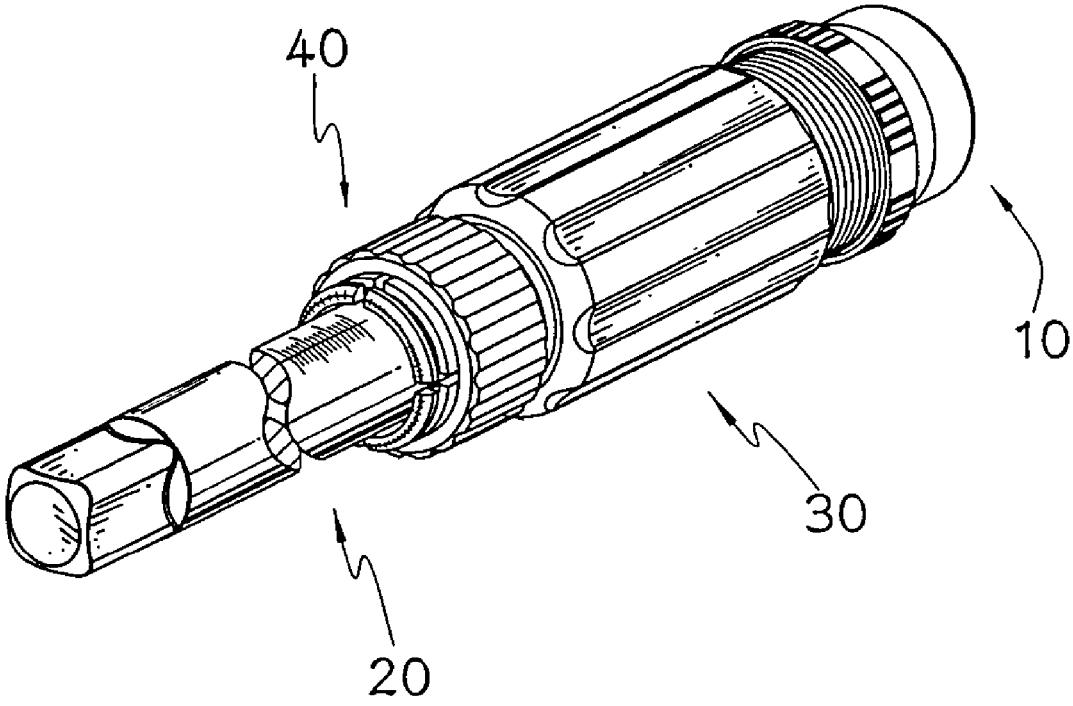
FIG. 3 is a perspective to show to show the tool of the present invention.

Referring to FIGS. 1 to 3, the torque adjustable tool "A" of the present invention comprises an active member 10 which has a first clutch portion 13 at a first end thereof and a second end of the active member 10 includes an engaging recess 11 so as to be connected with an electric tool (not shown) which transfers driving power to the active member 10. A threaded outer periphery 12 is defined in the first end of the active member 10.

A passive member 20 has an enlarged portion at a first end thereof and a second clutch portion 22 is defined in an end of the enlarged portion so as to be removably engaged with the first clutch portion 13 of the active member 10. A shaft 14 is co-axially connected between the active member 10 and the passive member 20 so as to ensure that the passive member 20 is co-axially rotated with the active member 10. A second end of the passive member 20 has a driving end 21 which is a rectangular end capable of connecting a sleeve or the like. A threaded outer periphery 23 is defined in an outer periphery of the passive member 20 and a plurality of marks 24 are marked beside the threaded outer periphery 23.

Figure 4:
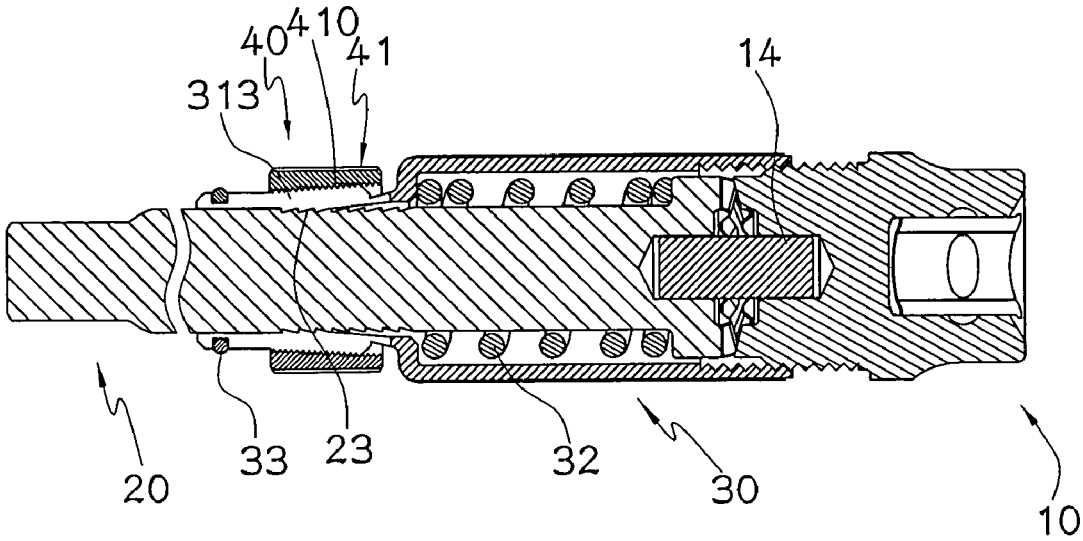
FIG. 4 shows that the locking member is operated to securely connect the control member and the passive member.

A safety device 30 includes a control member 31 which has an inner threaded periphery 310 defined in a first end thereof so as to be connected to the threaded outer periphery 12 of the active member 10. The passive member 20 extends through the control member 31 and a spring 32 is mounted to the passive member 20 and received in an interior 311 of the control member 31. One end of the spring 32 is stopped at the enlarged portion of the first end of the passive member 20 and the other end of the spring 32 is stopped by an inner periphery of a second end of the control member 31. A locking portion 313 is defined in the inner periphery of the clamping portion 312 so as to be optionally connected to a threaded outer periphery 23 defined in the outer periphery of the passive member 20. A clamping portion 312 is connected to the second end of the control member 31 and a plurality of slots 314 defined through the clamping portion 312 to form a plurality of sections separated by the slots 314. The sections of the clamping portion 312 are capable of closing inward and opening outward. A locking device 40 has a locking member 41 which includes inner threads 410 so as to be threadedly mounted to the clamping portion 312. A clamp 33 is mounted to an outer periphery of the clamping portion 312 so as to stop the locking member 41 from disengaging from the clamping portion 312. An inner periphery of the locking member 41 and an outer periphery of the clamping portion 312 are tapered so as to form a clamping mechanism such that the locking member 41 can be securely mounted to the clamping portion 312 by rotating the locking member 41 toward the active member 10 and the locking portion 313 of the clamping portion 312 is threadedly connected to the threaded outer periphery 23 of the passive member 20 as shown in FIG. 4. By this way, the control member 31 and the passive member 20 are combined as a one piece and may completely transfer the torque coming from the active member 10. In this situation, the tool "A" is operated as a general screw driver without any torque adjustment feature. When the locking member 41 is not tightly locked as shown in FIG. 2, the value of the output torque that can only be output from the passive member 20 is less than the force of the spring 32. If the force of the torque of the active member 10 is more than the force of the spring 32, the spring 32 is compressed and the first and second clutch portions 13 and 22 are separated. By this way, only pre-set torque is output so that the object to be tightened is protected.

Figure 5:
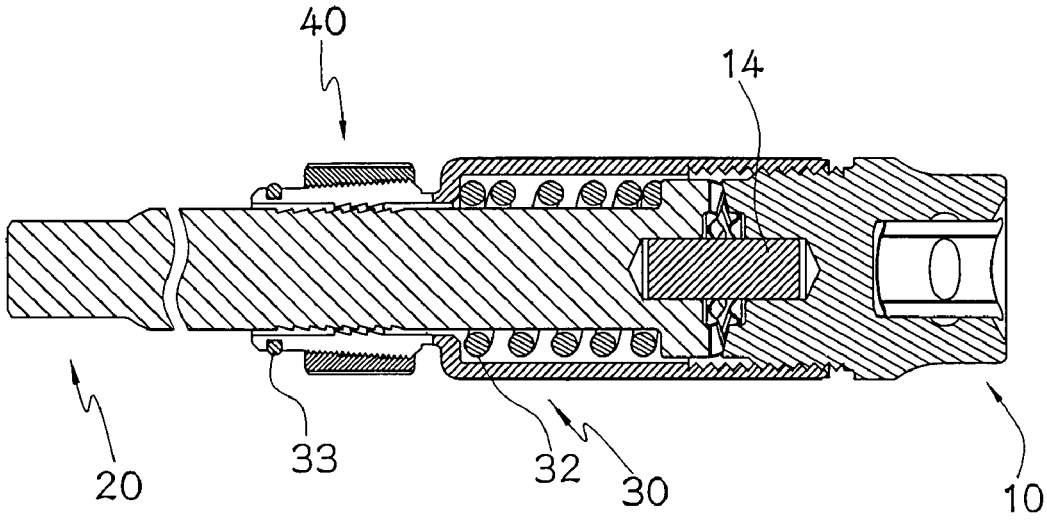
FIG. 5 shows that the spring is compressed by rotating the control member.

As shown in FIG. 5, the control member 31 can also be further threaded toward the active member 10 to compress the spring 32 so that the output torque can be set to be a larger torque. The user may check the values by the marks 24 on the passive member 20 or the marks 316 defined at an end of the safety device 30.

Figure 6:
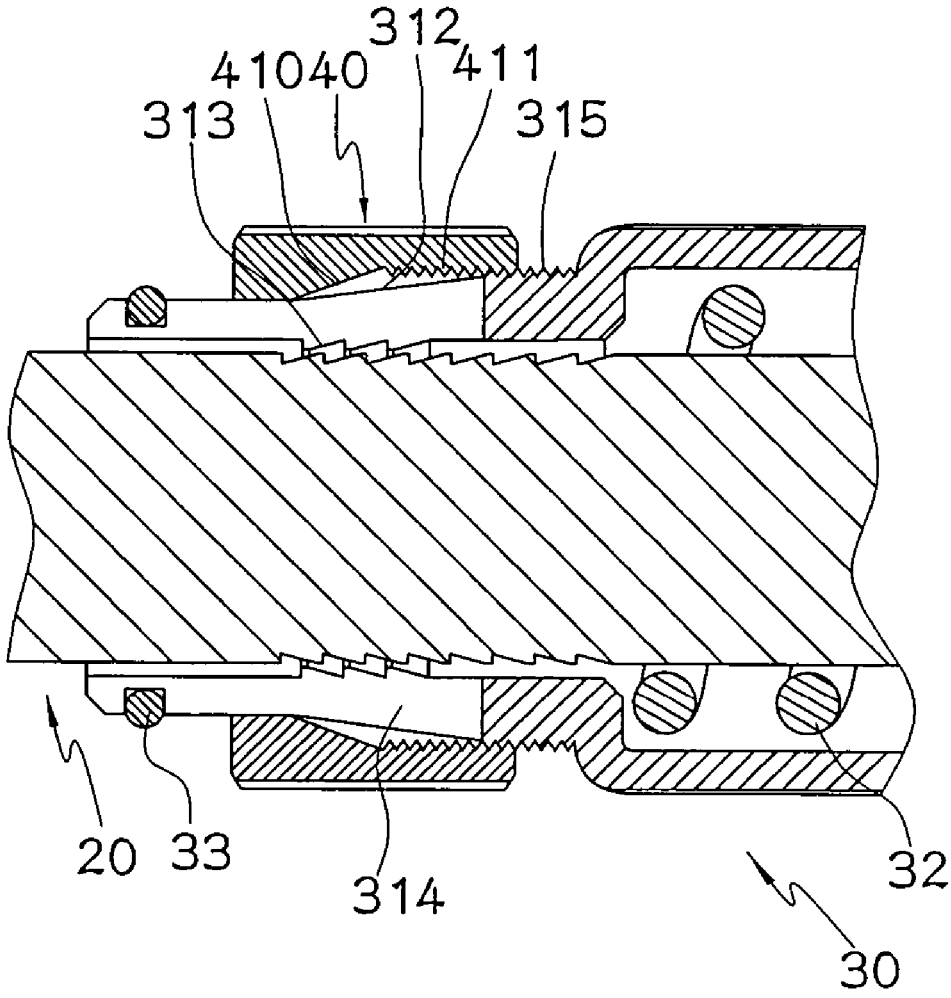
FIG. 6 shows another embodiment of the locking member and the clamping portion of the control member.

FIG. 6 shows another embodiment, wherein an inner periphery of the clamping member 41 includes a first inclined surface 410 and a threaded inner periphery 411 defined in a section with a fixed inner diameter of the clamping member 41. An outer periphery of the clamping portion 312 is a second inclined surface 312 which has a different slope from that of the first inclined surface 410. The threaded inner periphery 411 is threadedly connected to the clamping portion 312 so as to obtain different tightness between the control member 31 and the passive member 20.

While we have shown and described the embodiment in accordance with the present invention, it should be clear to those skilled in the art that further embodiments may be made without departing from the scope of the present invention.

What is claimed is:

1. A torque adjustable tool comprising:

an active member (10) having a first clutch portion (13) at a first end thereof and a passive member (20) having a second clutch portion (22) at a first end thereof, the second clutch portion (22) being removably engaged with the first clutch portion (13), a safety device (30) mounted to the active member (10) and the passive member (20), the safety device (30) having a control member (31) and a spring (32) located between the control member (31) and the first and second clutch portions (13, 22), the control member (31) including an inner threaded periphery (310) defined in a first end thereof and the spring (32) received an interior (311) of the control member (31), one end of the spring (32) stopped at an enlarged portion at the first end of the passive member (20) and the other end of the spring (32) being stopped at an inner periphery of a second end of the control member (31), a clamping portion (312) connected to the second end of the control member (31) and a locking portion (313) defined in an inner periphery of the clamping portion (312) so as to be connected to a threaded outer periphery (23) defined in an outer periphery of the passive member (20), a plurality of slots (314) defined through the clamping portion (312) such that the clamping portion (312) is capable of closing inward and opening outward, a locking device (40) having a locking member (41) which locks the active member (10) to be integral with the passive member (20), a clamp (33) mounted to an outer periphery of the clamping portion (312) so as to stop the locking member (41) from disengaging from the clamping portion (312).

2. The tool as claimed in claim 1, wherein a second end of the active member (10) includes an engaging recess (11).

3. The tool as claimed in claim 1, wherein a second end of the passive member (20) has a driving end (21).

4. The tool as claimed in claim 1, wherein an inner periphery of the locking member (41) and an outer periphery of the clamping portion (312) form a clamping mechanism so that the locking member (41) securely mounted to the clamping portion (312).

5. The tool as claimed in claim 1, wherein an inner periphery of the clamping member (41) includes a first inclined surface (410) and a threaded inner periphery (411) defined in a section with a fixed inner diameter of the clamping member (41), an outer periphery of the clamping portion (312) is a second inclined surface (312) which has a different slope from that of the first inclined surface (410), the threaded inner periphery (411) threadedly connected to the clamping portion (312).

6. The tool as claimed in claim 1, wherein a plurality of marks (24, 316) are marked between the safety device (30) and the passive member (20) so as to display the value of torques.

7. The tool as claimed in claim 6, wherein the marks (316) are defined at an end of the safety device (30) and the marks (24) are defined in an outer periphery of the passive member (20).

8. The tool as claimed in claim 1, wherein a shaft (14) is co-axially connected between the active member (10) and the passive member (20).

* * * * *